United States Patent [19]

Carlisle

[11] 4,073,021

[45] Feb. 14, 1978

[54] DIFFERENTIAL-PRESSURE FLOTATION CUSHION

[76] Inventor: Richard S. Carlisle, P.O. Box 307, Rye, N.Y. 10580

[21] Appl. No.: 663,544

[22] Filed: Mar. 3, 1976

[51] Int. Cl.[2] ..... A47C 27/08

[52] U.S. Cl. ..... 5/365; 5/370; 5/91

[58] Field of Search ..... 5/365, 370, 371, 91, 5/349, 350; 297/232, 454–456

[56] References Cited

U.S. PATENT DOCUMENTS

| | | | |
|---|---|---|---|
| 1,156,523 | 10/1915 | Clemens | 5/349 |
| 2,816,299 | 12/1957 | Holladay | 5/349 X |
| 3,702,484 | 11/1972 | Tobinick | 5/370 |
| 3,746,835 | 7/1973 | Yu | 5/370 |

*Primary Examiner*—Casmir A. Nunberg

[57] ABSTRACT

A flotation-type, low-pressure-gas (or fluid) cushion for the prevention of pressure sores is provided, which has a plurality of longitudinal compartments, wherein outer compartments are of much greater size than the inner compartments, and communicate with the inner compartments by restrictive passageways. When a user sits upright on the cushion, a substantially lower pressure is exerted on the coccygeal and anal/genital regions, relative to other regions. The larger outer compartments extend past the hips and trochanters of the user, thus increasing the area of surface contact, relative to prior art cushions. A modification of the cushion includes a surrounding envelope which contains fluid, but at a lower pressure than the fluid or gas pressure of the inner cushion. The additional outer fluid system exerts a relatively low, equalizing pressure on all portions of the contacted anatomy of the user. The inner cushion continues to exert differential pressure. The resultant pressure on the coccygeal and anal/genital regions equals approximately only the pressure of the outer system, whereas the pressure on other regions of the anatomy, such as the ischial tuberosities, equals the sum of the pressures of the respective systems. The said sum of the pressures generally is less than half the pressure ordinarily exerted against the ischial tuberosities by a folding wheelchair, flexible sling-type seat.

9 Claims, 5 Drawing Figures

DIFFERENTIAL-PRESSURE FLOTATION CUSHION

BACKGROUND OF THE INVENTION

1. Field of the Invention

This invention is a flotation device for prevention of decubitus ulcers, and the alleviation of coccygeal disorders.

2. Description of the Prior Art

There are available a great variety of flotation cushions and mattresses containing fluid substances, and intended to reduce pressure under bony prominences. This function decreases the incidence of sores which otherwise tend to develop in such areas.

All existing devices have one or more shortcomings. For example, most types tend to establish a relatively even pressure on all areas of the contacted anatomy. This is advantageous for reducing the pressure level under the ischial tuberosities, where pressure sores tend to develop. However, if the pressure level is dramatically reduced in one region or two regions while equalizing pressure universally, it means an unusual and generally undesirable increase tends to occur in other regions. Two such regions are the mid-thigh and the anal/genital regions. Long-term sitting on prior art devices, while being alright in relation to pressure sore development in the bony regions, tends to become uncomfortable due to the unusual pressure on these other regions, which are not accustomed to pressure loading of more than 25 mm Hg.

A serious shortcoming of prior art water cushions is severe lack of stability. A user tends to slip easily in any direction. Left to right (lateral) stability is especially lacking. Such cushions can ordinarily be used only in wheelchairs or similar devices with close-fitting lateral supports, to provide the stability which is inherently lacking in the cushion.

Prior art cushions are generally quite expensive. The instant invention can be produced at a fraction of current costs, making it essentially disposable.

SUMMARY OF THE INVENTION

Thermoplastic films of a preferred thickness of 0.002 to 0.010 inch are formed, by heat sealing, into a series of parallel, longitudinal compartments. The cushion is formed flat, and the compartment widths vary from about 75 mm (3 inches) at the outermost regions to about 18 mm (¾ inch) in the central region. An ideal number of compartments is eight or nine. They are interconnected by a series of restrictive passageways. Such passageways are provided by making the heat seals, which form the compartment boundaries, slightly shorter than the distance between the peripheral seams which form the front and back edge boundries of the cushion.

The cushion is formed of material, such as 6 mil polyethylene, which has limited elasticity. It is then inflated only to a slight positive pressure (less than 40 mm Hg). It must be pre-inflated, as the degree of inflation is very critical. There is an exact, critical balance between the degree of inflation and the elasticity of the thermoplastic material, in order to provide optimal softness while providing sufficient support. The degree of inflation varies directly with the degree of stretchiness of the material selected. Generally, the inflation level will be in the pressure range of from 1 to 20 mm of Hg. The cushion should be pre-filled and sealed hermetically, to avoid incorrect filling by the user.

An important addition to the cushion is a surrounding envelope of, preferably, thermoplastic material, similar to the cushion material. This envelope contains either air, or advantageously, a fluid of high weight and specific heat, such as water. The amount of such outer fluid is also critical, and it is preferably pre-filled and hermetically sealed, to avoid improper filling. The amount of fluid in the outer chamber must be sufficient to provide at least slight upward pressure against the entire anatomical contact area. This pressure is ideally about 15 to 20 mm Hg.

When water is used in the outer chamber, it allows a gradual increase in temperature of the compound cushion when in use over a period of several hours. If air is used in the inner cushion, a gradual expansion of the air occurs with the gradual temperature increase. As the air expands, and pressure increases, the inner cushion changes shape slightly. This is advantageous, as the pressure pattern changes slightly relative to the user's anatomy. This has an effect similar to a change of position for the user, which is of course advantageous for comfort, as well as for prevention of pressure sores.

The ischial pressure achieved by the use of the cushion equals at least a 50% reduction below the ischial pressure encountered with the use of an uncushioned seat. This occurs as a result of increasing the pressure in the near vicinity of the ischial tuberosities, and in the outer hip/trochanteric region, and under the mid-thighs. These areas are often touched only lightly, or not at all, by a wheelchair seat.

DESCRIPTION OF PREFERRED EMBODIMENTS

Figure 1:
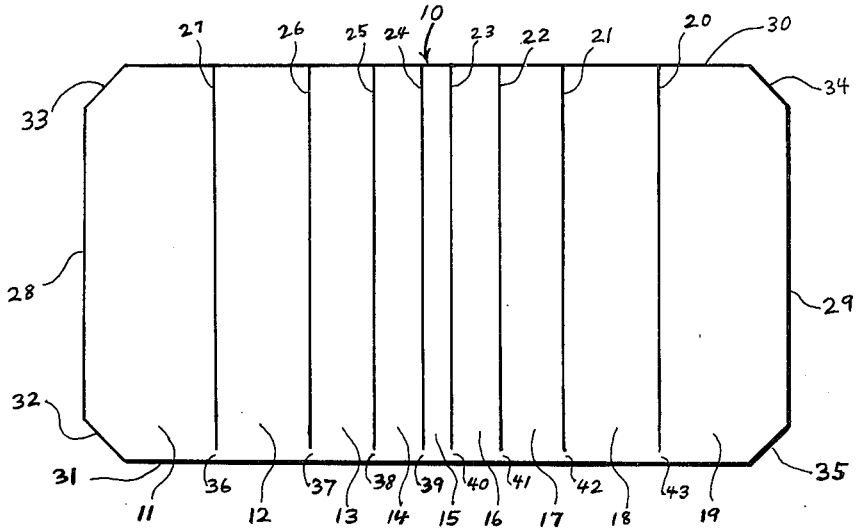
FIG. 1 is a plan view of an uninflated inner cushion.

Referring now to FIG. 1, a pair of films of the polyolefin group, such as polyethylene or polypropylene, are joined together with a plurality of heat-seals, or seams. Grades of vinyl material having softness properties similar to low density polyethylene, may also be used. The preferred thickness of the parent film is in a range of from 3 to 12 mil (0.075 to 0.30 mm). In practice to date, 5 to 7 mil films have been used sucessfully. 6 mil polyethylene of the low density type, is an example of a suitable film. It has the degree of softness, or suppleness, and the resistance to elongation, which are required for good functional performance in a cushion of this type. The resistance to elongation should be evaluated before utilizing a film for the present invention. To determine the elongation characteristic, prepare a strip of the material being tested having a width of 25 mm and a length of 305 mm. At 27° C and again at 37° C, the amount of elongation that occurs is measured when a tensile force of 2.72 Kg (6 lb) is applied to the end of the strip. The amount of elongation should be between 1.5% and 25% at 27° C, and between 3% and 35% at 37° C. These two temperatures represent the normal minimum and maximum operating temperatures for most applications.

Internal heat seals 20, 21, 22, 23, 24, 25, 26, and 27 provide boundaries for compartments 11, 12, 13, 14, 15, 16, 17, 18 and 19 by securely joining together the parent films along the length of the seams. The internal seams do not intersect the peripheral seam 31, but rather approach it, leaving unsealed regions 36, 37, 38, 39, 40, 41, 42 and 43. The distance between the ends of the internal seams and the peripheral seam 31 is preferably in the range of from 8 to 15 mm. It is a critical functional factor in a fluid-containing cushion of this type, to have the openings between the compartments of a size which permits inter-compartmental shifting of the fluid at an optimal rate. Thus, abrupt changes are avoided, which would otherwise cause lateral instability, while still enabling the compartments to yield slowly (within minutes) and conform to the anatomical configuration of a user. Similar openings to the ones shown may be provided between the opposite ends of the internal seams and peripheral seam 30. In some applications, it may be desirable to have the two sets of openings. Peripheral seams 28 and 29, along with diagonal corner seams 32, 33, 34 and 35 comprise the balance of the periphery. The diagonal seams enhance the appearance of the cushion, and tend to avoid undesirably pointed corner regions.

The distances between the internal seams determine the width and (potential) thickness of the compartments, when filled. The distances are critical for specific applications, and as an example, are as follows: compartment 11 equals 70 mm, 12 equals 55 mm, 13 equals 42 mm, 14 equals 25 mm, and 15 equals 16 mm. The opposite, corresponding compartments are the same size. In general, outer compartments 11 and 19 are at least as wide as compartments 12 and 18, and as much as 50% wider. The relationship between compartments 15 through 18, and the opposite corresponding compartments, is as follows: the compartments progressing outwardly from the central compartment 15 increase in width progressively to the extent of from 30% to 75%. This formula does not apply to the outermost compartments, which are either the same size as the adjacent compartments, or up to 50% larger in width. These measurements are made with the cushion flat and empty.

After the cushion is formed, using one of the heat sealing methods known in the art, it is filled with a fluid, preferably air. The degree to which it is filled varies according to the type of application. Generally, the actual pressure of the contained fluid will be below 40 mm Hg. The preferred range is from 5 to 20 mm Hg.

Figure 2:
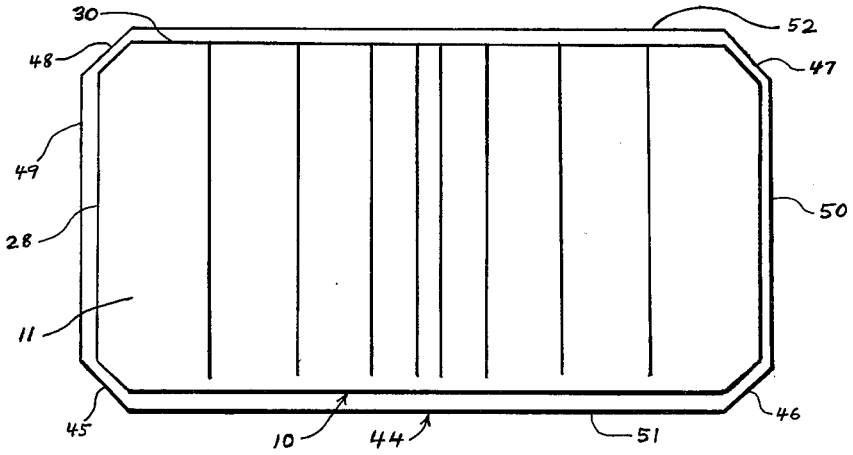
FIG. 2 is a plan view, still uninflated, and showing the addition of an outer envelope.
Figure 3:
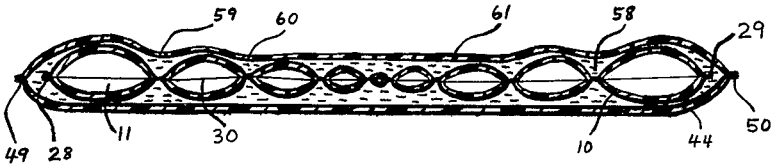
FIG. 3 is a cross sectional view of the device of FIG. 2, filled.
Figure 5:
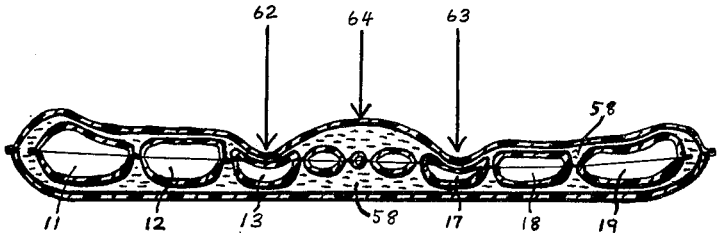
FIG. 5 is a view of the contact pattern when a human patient sits erect on the cushion of FIG. 3.

In FIG. 2, an outer film envelope 44 surrounds the cushion. It is formed with peripheral seams 45, 46, 47, 48, 49, 50, 51 and 52. It can be the same material as the parent film of the cushion. It is filled with a fluid such as air, or with water, as shown in cross section in FIG. 3. The quantity of fluid is quite low, being somewhat more than sufficient to fill in the crevices between the cushion compartments. Undulations 59 and 60 form directly over compartment boundaries. If the upward-facing surface of the envelope is punctured, fluid will not leak out from the envelope, if the cushion is not supporting a load. Rather, ambient air will rush in through the puncture opening. Such in-rushing air will cease after undulations 59 and 60 have substantially decreased, and the upper wall 61 becomes relatively straight across. In other words, the optimal amount of fluid for outer chamber 58 is sufficiently low, such that a sort of negative pressure exists in this chamber. The undulations in the upper surface (when unloaded), which disappear when the upper wall is punctured, serve to demonstrate this negative pressure. These characteristic undulations form when the outer chamber is filled either with air or water. If the bottom wall is punctured, air will rush in if the chamber is filled with air initially. If water is in the outer chamber and the bottom wall is punctured, then air will not rush in, but the water will not leak out either. The negative pressure thus maintains a static equalibrium. The pressure is effectively slightly less than neutral pressure, and difficult to measure by conventional means; it is certainly less than 5 mm Hg. This negative pressure undergoes a transition to positive pressure when a load is placed on the cushion. It reaches a maximum pressure of about 25 mm Hg under load, when supporting a user. As shown in FIG. 5, only the upper wall of the relatively low-pressure outer chamber 58 is exerted upward against the central anatomy of the user, designated by arrow 64. Under the ischial tuberosities, designated by arrows 62 and 63, the pressure of the outer chamber is added to the pressure of the enclosed cushion. This resulting differential pressure characteristic is important for avoiding high pressures in the anal/genital area, which is a problem with prior art flotation pads. Even though only a moderate amount of pressure is thus exerted against the central region (which shares some of the weight-bearing function in all flotation cushion applications), the ischial pressure which results from the cumulative pressures of the two chambers is, surprisingly, substantially less than the pressure developed with a standard folding wheelchair seat. For example, a 150 lb. patient develops approximately 95 to 120 mm Hg ischial pressure on a standard folding wheelchair. With the use of this cushion, the ischial pressure drops to approximately 40 to 60 mm Hg. With prior art cushions, ischial pressure may drop to about 35 mm Hg. However, this is a greater decrease than necessary for most applications. Unfortunately, with such cushions, the same value of 35 mm Hg tends to be exerted against the anal/genital region and the mid-thigh region. This is much more pressure than these regions are accustomed to, and discomfort results in many instances. Pressure against the mid-thigh region is especially critical with patients who have a varicose vein condition in this region. Since return circulation can easily be restricted by pressure on a varicose region, it is important to minimize pressure thereon.

With the cushion of this invention, the pressure of the outer chamber is ordinarily limited to approximately 15 to 20 mm Hg. This is the limit of pressure exerted against the central-region, which tends to become uncomfortable with pressures of more than 25 mm Hg. As shown in FIG. 5, the avoidance of cumulative pressures of the two fluid chambers against the central region is accomplished by making the central compartment of the inner cushion of a sufficiently small size so as to create a self-tethering effect. Thus, the central area of the inner cushion is prevented from expanding upward against the user, leaving only the upper wall of the outer chamber exerting a relatively low pressure of less than 25 mm Hg against the central region of the user.

Compartments 17, 18 and 19 in FIG. 5 show a greater degree of compression than compartments 11, 12 and 13. This illustrates the way the cushion takes shape and accomodates a patient leaning toward the compressed side.

Figure 4:
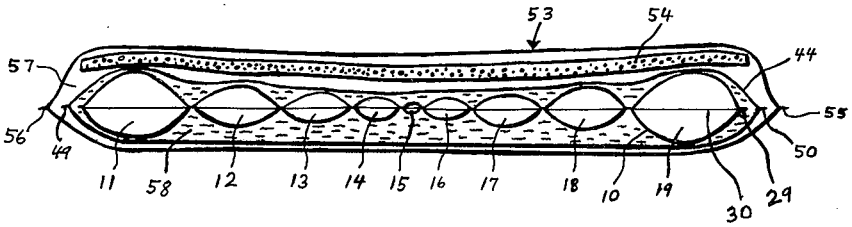
FIG. 4 is a cross sectional view of an alternate construction which includes a layer of foam material.

In FIG. 4, an insert 54, of soft, resilient material such as polyethylene foam is provided. An additional outer envelope 53, of material which can be the same as the material of the other cushion walls, is provided to retain the foam in place and protect it against soilage. Ventilation slits (not shown) may advantageously be provided near the marginal seams 55 and 56 to allow excess air 57 surrounding the foam to be exhausted when a user sits on the cushion.

For an average-size adult, the optimal dimensions for the completely assembled cushion are approximately 48.3 by 40.6 by 3.8 cm (average height) (19 by 16 inches by 1½ inches). This allows sufficient width for outer compartments 11 and 19 to extend partly up around the outer hip regions of the user. This increases the surface contact area, and enhances pressure reduction. These dimensions also provide a cushion size which is well adapted for use as a bed flotation device, when used in groups of five. Thus, the cushions are placed with the compartments aligned with the longitudinal axis of the patient. One cushion supports the head, the second supports the neck, shoulders and upper back, the third supports the lower back, the fourth supports the buttocks and upper thighs, and the fifth supports the lower legs.

A distinct advantage of this system is that one or more of the cushions can be removed from the bed during waking hours for chair use. Thus, duplicate purchasing of bed and chair flotation devices is avoided.

An alternate construction consists of deleting the envelope 44 and water chamber 58 in FIG. 4. Thus, a cushion device is provided consisting of inner cushion 10, soft resilient foam material 54, and outer retaining envelope 53. This device is advantageous for patients where a central pressure of less than 10 mm Hg is indicated. For example, patients recovering from rectal surgery would prefer this cushion for the first few days following surgery. After this initial period, the patient would switch to a cushion of the type having a water (or air) chamber 58 and envelope 44. The foam layer 54 may consist of polyurethane foam, vinyl foam, polyethylene foam, sponge rubber, or other materials having cushioning and pressure-distributing properties. Envelope 53 may be formed of upholstery material, such as Naugahyde, for optimal appearance and durability.

Inner cushion 10 may be alternately constructed with eight compartments rather than nine. This is particularly appropriate for smaller cushions, for example, cushions designed for very small child patients in wheelchairs. In the eight-compartment cushion, two centrally-disposed compartments are substituted for, and occupy the same lateral space as, the three centrally-disposed compartments 14, 15 and 16 of the nine-compartment cushion. Thus, all of the other six outwardly-disposed compartments 11, 12, 13, 17, 18 and 19 are maintained in the same sort of structural inter-relationship, and function in substantially the same way as they would if the cushion were constructed with nine compartments. The only difference is a slight increase in pressure near the central anatomical region. This is due to the two central compartments being respectively greater in width than the three central compartments for which they are substituted. This greater width reduces the "tethering" effect and allows the two compartments to become more expansive in height than any of the three compartments for which they are substituted.

Having thus described the subject invention, I claim:

1. A compartmented, fluid containing cushion for a person comprising an inner multiple compartmented cushion containing fluid at a positive pressure sufficient to support a person; and an outer fluid containing envelope enclosing said inner multiple compartmented cushion, said outer envelope containing fluid at a pressure which is selected sufficiently low to enable a portion of said outer envelope to undulate upwardly for support of a certain area of a person while another portion of said outer envelope is enabled to effectively rest upon said inner compartmented cushion for the latter's effective support of other areas of a person.

2. A cushion for supporting an irregularly-shaped load such as a seated person comprising a plurality of connected, fluid-containing inner chambers;

an outer fluid-containing envelope enclosing the inner chambers in free-floating relationship;

said inner chambers containing a fluid at a higher fluid pressure than said outer fluid-containing envelope, with the pressure in the outer envelope being selected to enable the irregularly shaped load to be at least in part supported at a first load region by said envelope and in at least two other separated parts effectively supported by the inner chambers at a second load region.

3. A flotation system for bed use, comprising a plurality of separable independent cushions, each cushion having an inner fluid pressure system comprising a plurality of compartments in fluid communication with each other (through restricted passageways), and having an outer fluid pressure system completely surrounding said inner fluid pressure system, said outer fluid pressure system containing fluid at a pressure sufficiently low to enable said outer system to undulate upwardly for support of a certain area of a person while another portion of said outer system is enabled to effectively rest upon said inner system for the latter's effective support of other areas of the person.

4. The cushion as in claim 1 wherein said multiple compartments communicate by restricted passageways limited to accomodate only a slow intercompartment flow of fluid for avoiding abrupt lateral instability of a seated person, while conforming in shape to the user's anatomical structure over a protracted period of time.

5. A cushion as in claim 1 wherein said compartmented cushion has elongated parallel compartments, sucessively wider in opposite directions from its centerline, for providing relatively low pressure against the central region of a user.

6. A cushion as in claim 5 wherein said compartments communicate by restricted passageways which accomodate only a gradual intercompartment flow of fluid.

7. A cushion as in claim 1, wherein said outer envelope contains liquid.

8. A cushion as in claim 1, wherein said outer envelope contains gas.

9. A cushion as in claim 1, having an additional outer envelope which contains a layer of soft insulating material between said cushion and said additional outer envelope.

* * * * *